US005365964A

United States Patent [19]

Sørensen

[11] Patent Number: 5,365,964

[45] Date of Patent: * Nov. 22, 1994

[54] VACUUM VALVE TO BE USED IN AN EMERGENCY SYSTEM TO REDUCE THE RISK OF ESCAPE OF LIQUID FROM TANKERS DUE TO INJURIES UNDER THE WATERLINE

[76] Inventor: Emil A. Sørensen, Schützenmatte 2A, CH-6362 Stansstad, Switzerland

[ * ] Notice: The portion of the term of this patent subsequent to Aug. 25, 2009 has been disclaimed.

[21] Appl. No.: 949,628

[22] PCT Filed: May 31, 1991

[86] PCT No.: PCT/DK91/00147

§ 371 Date: Dec. 1, 1992

§ 102(e) Date: Dec. 1, 1992

[87] PCT Pub. No.: WO91/19126

PCT Pub. Date: Dec. 12, 1991

Related U.S. Application Data

[63] Continuation of Ser. No. 665,803, Mar. 6, 1991, Pat. No. 5,213,127.

[30] Foreign Application Priority Data

Jun. 1, 1990 [DK] Denmark ..... 1357/90

[51] Int. Cl.[5] ..... F16K 17/32; F16K 17/40

[52] U.S. Cl. ..... 137/68.1; 137/495; 137/526

[58] Field of Search ..... 137/68.1, 460, 463, 137/456, 70, 71, 526, 587, 495; 251/82

[56] References Cited

U.S. PATENT DOCUMENTS

| | | | |
|---|---|---|---|
| 2,732,856 | 1/1956 | Jurs et al. | 137/526 X |
| 4,518,014 | 5/1985 | McAlpine | 137/526 X |
| 4,844,113 | 7/1989 | Jones | 137/460 X |
| 5,213,127 | 5/1993 | Sorensen | 137/68.1 |

FOREIGN PATENT DOCUMENTS

| | | |
|---|---|---|
| 1803822 | 5/1970 | Germany . |
| 2113357 | 8/1983 | United Kingdom . |
| WO90/06462 | 6/1990 | WIPO . |
| WO90/10168 | 9/1990 | WIPO . |

*Primary Examiner*—Martin P. Schwardron
*Assistant Examiner*—Kevin L. Lee
*Attorney, Agent, or Firm*—Pravel, Hewitt, Kimball & Krieger

[57] ABSTRACT

A vacuum valve for use in a tanker is constructed with means (11, 12, 13, 33, 35, 36) for applying a supplemental closing force to the valve body if the pressure drop across the vacuum valve rises substantially above a value designated for the vacuum valve. Such an extraordinary rise of the pressure drop will occur by escapage from an injury under the waterline caused by grounding, and the supplemental closing force will therefore close the valve very fast and will thereby contribute to maintaining a high vacuum in the tank, counteracting continued escape.

14 Claims, 2 Drawing Sheets

Figure 1:
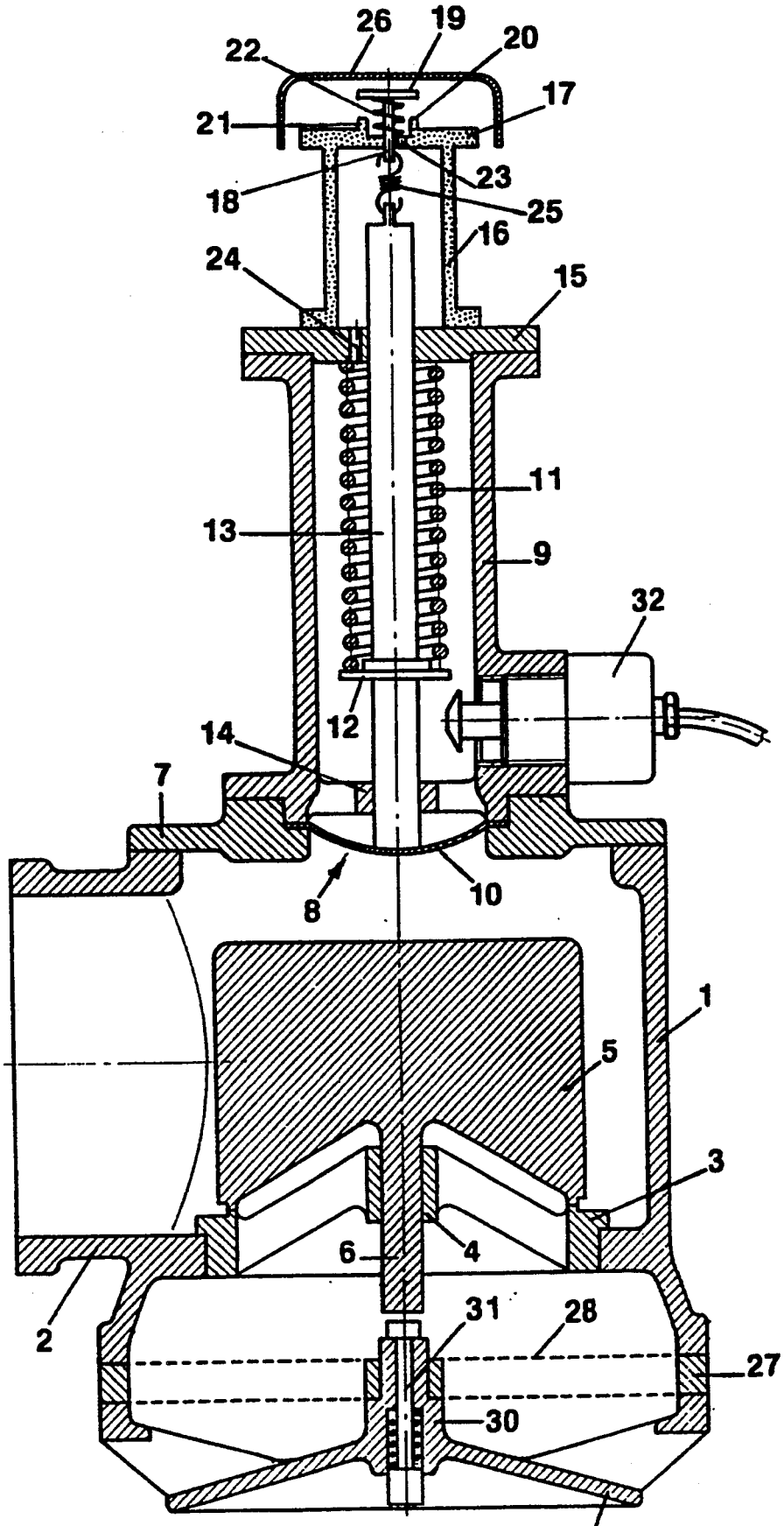

VACUUM VALVE TO BE USED IN AN EMERGENCY SYSTEM TO REDUCE THE RISK OF ESCAPE OF LIQUID FROM TANKERS DUE TO INJURIES UNDER THE WATERLINE

This is a continuation of co-pending U.S. patent application Ser. No. 07/665,803, filed on Mar. 6, 1991, now U.S. Pat. No. 5,213,127.

The invention relates to a vacuum valve to be used in an emergency system to reduce the risk of escape of liquid from tankers due to injuries under the waterline, e.g. caused by grounding.

In connection with various tanker disasters which have resulted in comprehensive environmental detriment, efforts have been displayed in many quarters, including authorities and classification agencies, to develop principles for such emergency systems, but it has been found difficult to establish standards which can be generally observed without considerable excess expenses and inconvenience to the trade.

The fundamental concept presenting itself for such emergency systems can briefly be described as follows:

Only escape from injuries under the waterline will be considered, because the possibilities of dealing with injuries above the waterline are practically nil.

For injuries occurring under the waterline it is attempted to reduce the escape by closing all inlets to the tank, so that an escape will rapidly create a vacuum which prevents the part of the cargo still present in the tank from flowing out into the surrounding environment.

By studies and calculations it has been ascertained that the closing of the inlets to the tank must be completed within a time interval of 5 to 10 seconds and therefore will have to be effected automatically. A possible solution would be an arrangement e.g. controlled by a level sensor which in response to a sudden drop of level automatically activates an isolation of the cargo tank, e.g. by means of hydraulically controlled stop valves. To maintain the vacuum thereby created in the tank, a vacuum pump or ejector may subsequently be set in operation for continuously removing the vapors developed owing to the change of boiling point of the cargo. However, the most critical phase is the fastest possible closing of all inlets to the tank with the greatest possible certainty. For a tanker in voyage the inlets will first and foremost be the vacuum valves with which a tanker is usually equipped for the purpose of relieving vacuum in the tank caused by temperature variations or during unloading of the tank.

It is the object of the invention to provide a vacuum valve, which in response to the outflow of a large quantity of liquid per time unit, such as will occur at the initiation of an escape from an injury under the waterline of a tanker, is automatically self-blocking and istherefore ideally suitable for emergency systems of the kind considered.

The invention is applicable to a vacuum valve of the well known kind comprising a valve housing connected to the top of a tank of the tanker and having a valve opening with a valve seat, a valve body within said valve housing serving to close and open said valve opening, said valve body having an outer side subjected to the pressure of the atmosphere outside said valve housing and an inner side subjected to the pressure in the interior of said tank, said valve body being subjected to a built-in closing force counteracted by an opening force, the valve being opened when said opening force resulting from the pressure difference between the outer and inner side of the valve body is positive and exceeds said built-in closing force during outflow of liquid from the tank so that then air is sucked in through the valve opening and creates a pressure drop from the atmosphere across the valve to the interior of the valve housing, said pressure drop increasing with the rate of inflow of air.

A vacuum valve of this kind is illustrated in the drawing of U.S. Pat. No. 3,999,471.

To achieve the object set forth above, a vacuum valve of the kind referred to is provided with stand-by biasing means to cause a supplemental biasing closing force which is applied to said valve body to close said valve opening in response to the occurrence of a pressure drop across said valve beyond a predetermined critical value.

At the initiation of an escape from an injury under the waterline of a tanker, a vacuum valve constructed as set forth is immediately closed as a direct consequence of the high pressure drop across the valve caused by the extraordinarily high rate of outflow of liquid from the tank and the correspondingly high rate of inflow of air through the valve opening, and the valve thus acts both as a sensor and as an activator. In this manner the vacuum valve constitutes a self-contained emergency unit, i.e. a unit which does not depend on the correct functioning of other emergency equipment. Moreover, it is very fast-operating and reliable.

Figure 2:
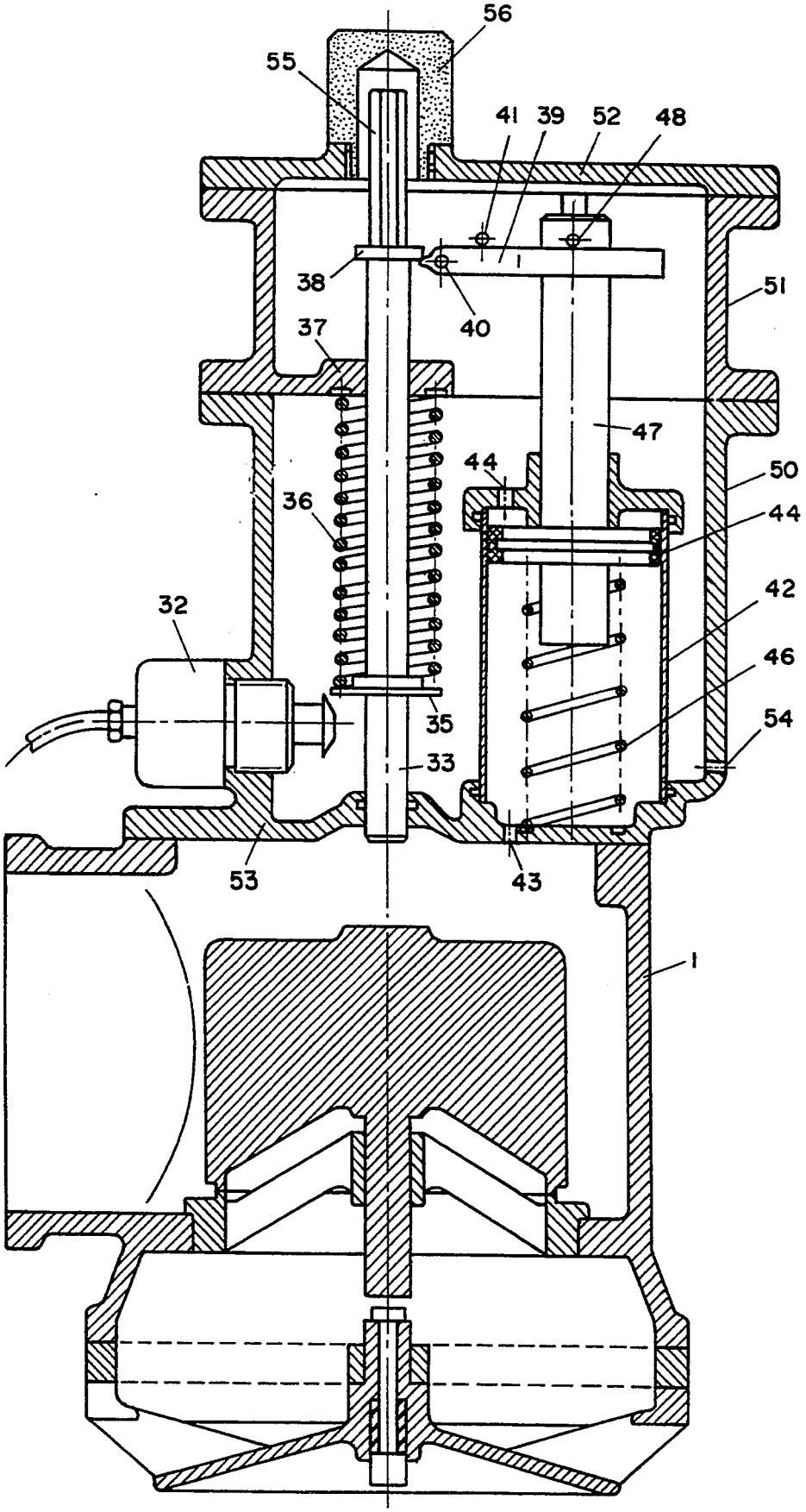

The invention will now be described in further detail with reference to the accompanying drawings, in which FIG. 1 is a vertical section through a vacuum valve according to one embodiment of the invention, and FIG. 2 is a vertical section through a vacuum valve according to another embodiment of the invention.

The vacuum valve shown in FIG. 1 has a valve housing 1 which at its left end is constructed with a connecting portion 2 that may be connected either directly to the top of a tank, or e.g. to the socket of a high velocity pressure venting valve, e.g. as shown and described in the above mentioned U.S. Pat. No. 3,999,571.

The valve housing has a bottom opening in which is mounted a valve seat 3 carrying a valve guide 4. The valve seat is engaged by a valve body 5, which by means of a stem 6 is guided in the valve guide 4. The valve housing 1 is closed at its top by means of a cover 7 having an opening 8 located centrally above the valve body 5. A spring housing 9 is mounted in the opening 8, a rupture disc 10 being clamped between the spring housing 9 and a landing face formed in the opening 8. In the spring housing a compressional spring 11 is arranged which is held under compression between a cover 15 of the spring housing 9 and a collar 12 on a stem 13, the lower end of which engages the rupture disc 10. The stem is guided near its lower end by a guiding hub 14 carried by the spring housing 9, and at its upper end extends through a hole in the cover 15. A hood 16 having a top wall 17 is mounted on top of the cover 15. A pin 18 is slidably mounted in a hole of the top wall and at its top carries a valve body 19 for cooperation with a valve seat 20 formed by a collar 21 on top of the wall 17. A compressional spring 22 normally keeps the valve body 19 lifted from the seat 20. Inside the collar 21 the cover has a venting hole 23 which together with a venting hole 24 in the cover 15 forms a venting path from the surroundings to the interior of the spring housing 9. The upper end of the stem 13 is connected with the lower end of the pin 18 by means of a tensile spring 25. In the normal position of the parts the tensile spring 25 is practically non-stretched. The top wall 17 and the valve body 19 are covered by a protective cap 26.

At its bottom, the vacuum valve is in well-known manner constructed with a net ring 27 carrying a double flame arresting net 28, and with a shield 29 having a hub 30 accomodating a check-lifting button 31.

The valve body 5 is urged towards the valve seat 3 by a built-in closing force which in the embodiment illustrated is constituted by the gravity of the valve body. In the vacuum condition of the tank, the closing force is counter-acted by a lifting force which is equal to the free area of the underside of the valve body 5 multiplied by the pressure difference between the underside and the upper side of the valve body, i.e. between the ambient pressure and the pressure in the valve housing 1, and thereby in the tank with which the vacuum valve is connected. If a vacuum comes up in the tank, the valve body will be lifted when the lifting force exceeds the built-in closing force, and thereby air will flow from the surroundings via the valve opening and the interior of the valve housing to the tank. When the pressure in the tank thereby rises to a value equal to the ambient pressure less the pressure drop across the valve, the lifting force will be equal to the built-in closing force, and the valve is again closed.

In this manner a pressure difference relief will take place both at variations of temperature and barometric level during voyage, and at unloading of the tank at a destination.

If, during unloading of the tank, a certain volumetric quantity of liquid is unloaded per time unit, i.e. measured in $m^3/h$, the same volumetric quantity of air should flow in through the vacuum valve. Thereby a pressure drop will be produced across the valve, and owing to the flow resistance across the valve, this pressure drop will be the greater, the greater the unloading quantity of liquid per time unit. If the flow resistance from the valve housing to the tank is disregarded, the tank pressure will be equal to the ambient pressure less the pressure drop across the valve, or in other words the relative vacuum in the tank will be equal to the pressure drop across the valve.

In constructing a vacuum valve, this is normally dimensioned for a certain designated unloading rate, at which the vacuum in the tank is kept at a value that does not give rise to problems in pumping out the liquid even under the most unfavourable conditions. Thereby, a designated pressure drop across the valve during unloading is at the same time defined. However, it should be permissible to exceed the designated unloading rate, and thereby the designated pressure drop across the valve up to a certain limit.

As an example, the built-in closing force of a vacuum valve may be so selected that the valve is opened at a vacuum of 350 mmWC, and that the pressure drop across the valve amounts to 700 mmWC at the designated unloading rate.

If the tank is subjected to a substantial injury, i.e. caused by grounding of the tanker, an outflow of liquid from the tank is immediately started at a rate far exceeding the designated unloading rate. Now, the rupture disc 10, which is subjected on its upper side to the ambient pressure through the venting openings 23 and 24, and on its underside to the pressure in the vacuum valve housing 1, is so dimensioned that it bursts when the pressure drop across the vacuum valve reaches a predetermined critical value substantially exceeding the designated value. In the numerical example considered, the critical value of the pressure drop may e.g. be selected at 1000 mmWC.

When the rupture disc bursts, the spring 11 will urge the stem 13 against the valve body and will thereby subject the latter to a supplemental biasing closing force, whereby the valve is immediately closed. Thus, the spring 11 and the stem 13, in combination with the rupture disc 10, act as a stand-by biasing means which in an emergency situation immediately applies a supplemental biasing closing force to the valve body 5. At the same time the tensile spring 25 will pull the valve body 19 against its seat 20, superseding the force of the compressional spring 22, and will thereby stop the admission of air from the exterior through the venting openings 23 and 24, the spring housing 9 and the broken rupture disc 10 to the vacuum valve housing 1. Consequently, the vacuum in the tank is maintained, and since no further air is thereafter admitted to the tank only a strictly limited quantity of liquid may still flow out through the leakage.

The spring force of the spring 11 should be so dimensioned as to secure the tank against collapse.

If the hood 16 is made from a transparent material or is constructed with a window, which may be provided with markings, it is possible to observe from outside whether the vacuum valve has gone into the emergency position. If this has taken place by an incidental occurrence, that has not been caused by an extraordinary sudden outflow of liquid in a catastrophic situation, it may be advisable, with observation of all safety procedures required, to dismount the spring housing and to mount a new rupture disc, so as to restore the vacuum valve to its normal functional range and again place it in readiness for coping with a catastrophe.

If desired, the movement of the stem 13 in a catastrophic situation can additionally be utilized for releasing a command signal for other emergency equipment, such as stop valves for other inlets to the tank, or a vacuum pump or ejector for maintaining the vacuum. All that is required for this purpose is a simple switch or contactor that is switched on or switched off pursuant to the movement of the stem 13. As an example, FIG. 1 shows a switch or contactor 32 which is mounted on the wall of the spring housing 9 and is adapted to be activated by the disc 12 in the course of the downward movement of the stem 13 upon breakage of the rupture disc.

In the embodiment of FIG. 2, an upper housing consisting of two housing parts 50, 51 and a top cover 52 is mounted on top of the valve housing 1. The bottom wall 53 of the upper housing forms at the same time the top wall of the valve housing 1. A stem 33 is mounted in the upper housing 50, 51 and extends sealingly through the wall 53 into the interior of the valve housing 1. The stem 33 carries a disc 35, which is urged downwards by a compressional spring 36 abutting a fixedly mounted support 37. Above the latter, the stem carries a locking disc 38 which is locked by a rocking lever 39 pivoted at 40 and engaging a fixedly mounted stop 41.

Laterally of the stem 33 a cylinder 42 is mounted, which at its bottom communicates with the interior of the valve housing 1 through an opening 43 and at its top communicates through an opening 44 with the interior of the upper housing 50, 51, which again communicates with the ambient atmosphere through an opening 54. In the cylinder there is provided a piston 45 which rests against a compressional spring 46 and has a piston rod 47 extending upwardly through the top of the cylinder 42 and being provided with a cross-pin 48 overhanging the rear arm of the rocking lever 39.

When the pressure in the vacuum valve drops, the piston 45 is urged downwards, and if the pressure drop across the valve reaches the predetermined critical value, the cross-pin 48 turns the lever 39 about the pivot 40 to an angular position in which it liberates the stem 33, so that the latter is urged against the valve body 5 by the spring 36 and thereby produces the prescribed supplemental biasing closing force acting on the valve body.

The stem 33 has an extension 55, which extends through an opening in the top cover 52 into a hood 56, that can be used for inspection in the same manner as the hood 16 in FIG. 1.

A contactor 32 corresponding to that in FIG. 1 is mounted in the wall of the housing part 50.

The vacuum valve according to the invention can be used in combination with any form of pressure venting valve, and it can also be used in combination with a system for injecting an inert gas above the liquid level in the tank at a pressure slightly above that of the ambient air.

I claim:

1. A vacuum valve comprising:

a) a valve housing having a valve opening;

b) a valve body within said valve housing having inner and outer sides, and being adapted to close and to open, said valve opening under the influence of a biasing closing force counteracted by an opening force resulting from the difference of fluid pressure between the outer and inner sides of the valve body;

c) biased actuating means mounted in a position to act on said valve body for applying a supplemental biasing closing force thereto; and d) means sensitive to the pressure difference between the ambient atmosphere and the interior of the valve housing and constructed to withhold said actuating means from acting on the valve body as long as said pressure difference remains below a predetermined critical value, and for liberating said actuating member for action if the pressure difference assumes a value exceeding said critical value.

2. A vacuum valve comprising:

a) a valve housing connectible to a tank and having a flow inlet portion;

b) a valve seat in the valve housing;

c) a valve body movable between open and closed positions for valving flow at the valve seat;

d) first biasing closing force means for urging the valve body toward a closed position on the seat;

e) second, supplemental biasing closing force means generating a second, supplemental closing force on the valve body in response to an increase in pressure drop across the valve between the ambient atmosphere and the interior of the valve housing beyond a preselected critical pressure drop value.

3. The apparatus of claim 2 wherein the first biasing closing force means is a weighted portion of the valve body that urges the valve body towards the valve seat under the influence of gravity.

4. The apparatus of claim 2 wherein the supplemental closing force means includes a stem that is movable with respect to the housing between a first seating position and a second loading position and wherein the stem exerts a closing force against the valve body in the second, loading position.

5. The apparatus of claim 4 further comprising a spring that urges the stem into the loading position.

6. The apparatus of claim 2 further comprising holding means for maintaining the second, supplemental biasing closing force means in a first position spaced away from the valve body as long as the pressure drop across the valve remains below the preselected critical value.

7. The apparatus of claim 6 wherein the holding means is a rupture disk.

8. The apparatus of claim 6 wherein the holding means includes a movable lever that holds the stem, and pressure drop responsive means for shifting the lever so that the lever disengages the stem.

9. The apparatus of claim 6 further comprising switch means for triggering a command signal for other safety equipment when the supplemental biasing closing force means is actuated.

10. A vacuum valve comprising:

a) a valve housing connectible to a tank and having a valve opening with a valve seat;

b) a valve body within said valve housing serving to close and open said valve opening;

c) said valve body having an outer side subjected to the pressure of the atmosphere outside said valve housing and an inner side subjected to the pressure in the interior of said valve housing;

d) said valve body being subjected to a biasing closing force;

e) the valve being opened when the force resulting from the pressure difference between the outer side and the inner side of the valve body is positive (i.e. inwardly directed) and exceeds said biasing closing force;

f) whereby air is sucked in through the valve opening and creates a pressure drop from the ambient air across the valve to the interior of the valve housing, said pressure drop increasing with the rate of inflow of air; and g) stand-by biasing means for causing a supplemental biasing closing force to be applied to the valve body in response to the occurrence of a pressure drop across the valve beyond a predetermined critical value.

11. The vacuum valve of claim 10 wherein said stand-by biasing means comprise:

a) a biased actuating member mounted in a position such as to be capable of acting on the valve body to apply a supplemental closing force thereto under the influence of the bias; and b) means sensitive to the pressure difference between the ambient air and the interior of the valve housing and constructed to withhold said actuating member from acting on the valve body as long as said pressure difference remains below said critical value, but to liberate said actuating member for action, if said pressure difference assumes a value beyond said critical value.

12. The vacuum valve of claim 11 wherein the pressure difference sensitive means comprise a rupture disc mounted in an opening of the valve housing and dimensioned for bursting at a value of said pressure difference corresponding to said predetermined value.

13. The vacuum valve of claim 10, further comprising means for releasing a command signal for other safety equipment in response of action of said stand-by biasing means.

14. A vacuum valve comprising:

a) a valve housing connected to a tank and having a valve opening with a valve seat;

b) a valve body within said valve housing serving to close and open said valve opening;

c) said valve body having an outer side subjected to the pressure of the atmosphere outside said valve housing and an inner side subjected to the pressure in the interior of said tank;

d) said valve body being subjected to a built-in closing force which is counteracted by an opening force, the valve being opened when said opening force resulting from the pressure difference between the outer and inner side of the valve body is positive and exceeds said built-in closing force during outflow of liquid from the tank so that then air is sucked in through the valve opening and creates a pressure drop from the atmosphere across the valve to the interior of the valve housing, said pressure drop increasing with the rate of inflow of air; and e) said valve being provided with stand-by biasing means to cause a supplemental biasing closing force which is applied to said valve body to close said valve opening in response to the occurrence of a pressure drop across said valve beyond a predetermined critical value.

* * * * *